US005516097A

United States Patent [19]

Huddleston

[11] Patent Number: 5,516,097

[45] Date of Patent: May 14, 1996

[54] FLEXIBLE SECTION BASEBALL BAT

[76] Inventor: Allen D. Huddleston, P.O. Box 143, Deport, Tex. 75435

[21] Appl. No.: 421,301

[22] Filed: Apr. 13, 1995

[51] Int. Cl.[6] ..... A63B 59/06

[52] U.S. Cl. ..... 273/26 B; 273/72 R

[58] Field of Search ..... 273/26 B, 72 R

[56] References Cited

U.S. PATENT DOCUMENTS

| | | | |
|---|---|---|---|
| 1,509,733 | 9/1924 | Langford | 273/72 R |
| 4,399,996 | 8/1983 | Boyce | 273/26 B |
| 4,555,111 | 11/1985 | Alvarez | 273/26 B |
| 4,634,121 | 1/1987 | Sasaki | 273/26 B |
| 4,671,508 | 6/1987 | Tetreault | 273/26 B |
| 5,035,428 | 7/1991 | Bartkowicz | 273/72 R |
| 5,259,610 | 11/1993 | Erb | 273/72 R |
| 5,338,035 | 8/1994 | Lyford | 273/186.2 |
| 5,342,046 | 8/1994 | Erb | 273/72 R |

*Primary Examiner*—William H. Grieb

[57] ABSTRACT

A bat for impacting a baseball to accelerate the ball away from a batter. The inventive device includes a baseball bat having an enlarged head portion for impacting a ball and a handle portion for manual grasping of the bat. A resilient coupling assembly is interposed between the head portion and the handle portion to permit resilient articulation of the head portion relative to the handle portion.

1 Claim, 3 Drawing Sheets

FLEXIBLE SECTION BASEBALL BAT

BACKGROUND OF THE INVENTION

1. Field of the Invention

The present invention relates to baseball equipments and more particularly pertains to an flexible section baseball bat for impacting a baseball to accelerate the ball away from a batter.

2. Description of the Prior Art

The use of baseball equipments is known in the prior art. More specifically, baseball equipments heretofore devised and utilized are known to consist basically of familiar, expected and obvious structural configurations, notwithstanding the myriad of designs encompassed by the crowded prior art which have been developed for the fulfillment of countless objectives and requirements.

Known prior art baseball equipments include U.S. Pat. No. 5,338,035; U.S. Pat. No. 5,342,046; U.S. Pat. No. 5,259,610; U.S. Pat. No. 5,035,428; U.S. Pat. No. 4,634,121; and U.S. Pat. No. 4,671,508.

While these devices fulfill their respective, particular objectives and requirements, the aforementioned patents do not disclose a flexible section baseball bat for impacting a baseball to accelerate the ball away from a batter which includes a baseball bat having an enlarged head portion for impacting a ball and a handle portion for manual grasping of the bat, with a resilient coupling assembly interposed between the head portion and the handle portion to permit resilient articulation of the head portion relative to the handle portion during swinging of the bat.

In these respects, the flexible section baseball bat according to the present invention substantially departs from the conventional concepts and designs of the prior art, and in so doing provides an apparatus primarily developed for the purpose of impacting a baseball to accelerate the ball away from a batter.

SUMMARY OF THE INVENTION

In view of the foregoing disadvantages inherent in the known types of baseball equipments now present in the prior art, the present invention provides a new flexible section baseball bat construction wherein the same can be utilized for impacting a baseball to accelerate the ball. As such, the general purpose of the present invention, which will be described subsequently in greater detail, is to provide a new flexible section baseball bat apparatus and method which has many of the advantages of the baseball equipments mentioned heretofore and many novel features that result in a flexible section baseball bat which is not anticipated, rendered obvious, suggested, or even implied by any of the prior art baseball equipments, either alone or in any combination thereof.

To attain this, the present invention generally comprises a bat for impacting a baseball to accelerate the ball away from a batter. The inventive device includes a baseball bat having an enlarged head portion for impacting a ball and a handle portion for manual grasping of the bat. A resilient coupling assembly is interposed between the head portion and the handle portion to permit resilient articulation of the head portion relative to the handle portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new flexible section baseball bat apparatus and method which has many of the advantages of the baseball equipments mentioned heretofore and many novel features that result in a flexible section baseball bat which is not anticipated, rendered obvious, suggested, or even implied by any of the prior art baseball equipments, either alone or in any combination thereof.

It is another object of the present invention to provide a new flexible section baseball bat which may be easily and efficiently manufactured and marketed.

It is a further object of the present invention to provide a new flexible section baseball bat which is of a durable and reliable construction.

An even further object of the present invention is to provide a new flexible section baseball bat which is susceptible of a low cost of manufacture with regard to both materials and labor, and which accordingly is then susceptible of low prices of sale to the consuming public, thereby making such flexible section baseball bats economically available to the buying public.

Still yet another object of the present invention is to provide a new flexible section baseball bat which provides in the apparatuses and methods of the prior art some of the advantages thereof, while simultaneously overcoming some of the disadvantages normally associated therewith.

Still another object of the present invention is to provide a new flexible section baseball bat for impacting a baseball to accelerate the ball away from a batter.

Yet another object off the present invention is to provide a new flexible section baseball bat which includes a baseball bat having an enlarged head portion for impacting a ball and a handle portion for manual grasping of the bat, with a resilient coupling assembly interposed between the head portion and the handle portion to permit resilient articulation of the head portion relative to the handle portion during swinging of the bat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
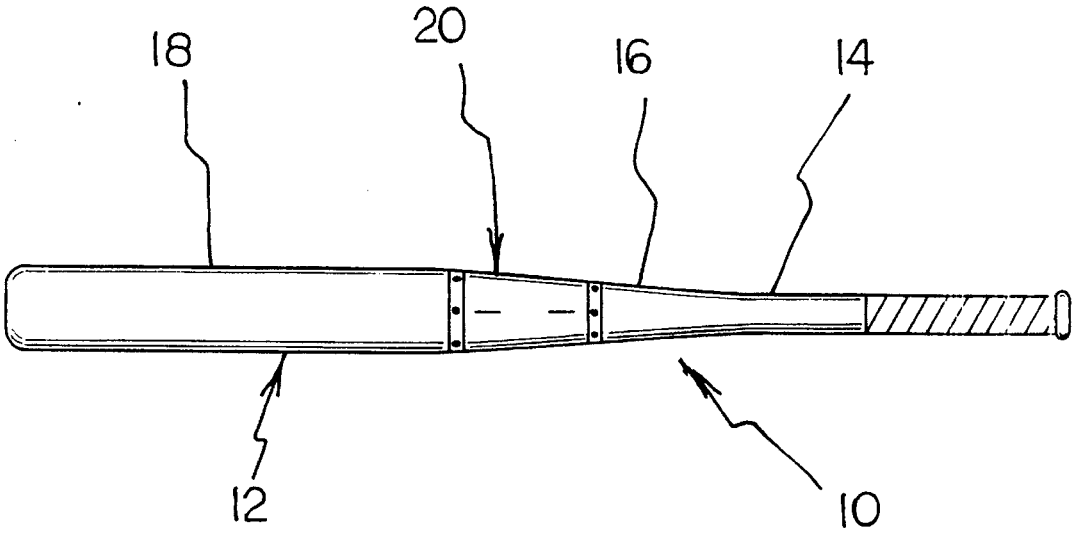
FIG. 1 is an elevation view of a flexible section baseball bat according to the present invention.
Figure 2:
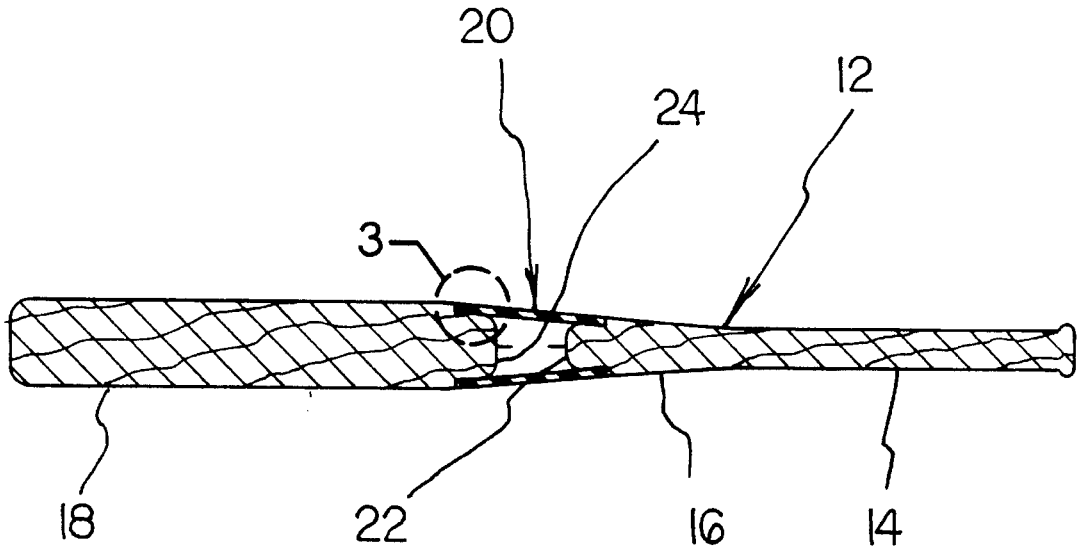
FIG. 2 is a cross sectional view taken along a longitudinal length of the invention.

With reference now to the drawings, and in particular to FIGS. 1–6 thereof, a new flexible section baseball bat embodying the principles and concepts of the present invention and generally designated by the reference numeral 10 will be described.

More specifically, it will be noted that the flexible section baseball bat 10 comprises a baseball bat 12 including a handle portion 14 for being grasped and manipulated by an individual during use of the device 10. The handle portion 14 is shaped so as to define a tapered neck portion 16 of increasing cross sectional dimension substantially as shown in FIG. 1. The baseball bat 12 includes a head portion 18 for impacting a baseball to accelerate the ball away from an individual. A resilient coupling means 20 is interposed between the tapered neck portion 16 and the head portion 18 for permitting resilient articulation of the head portion relative to the handle portion 14 during swinging of the bat 10 by a user.

Figure 3:
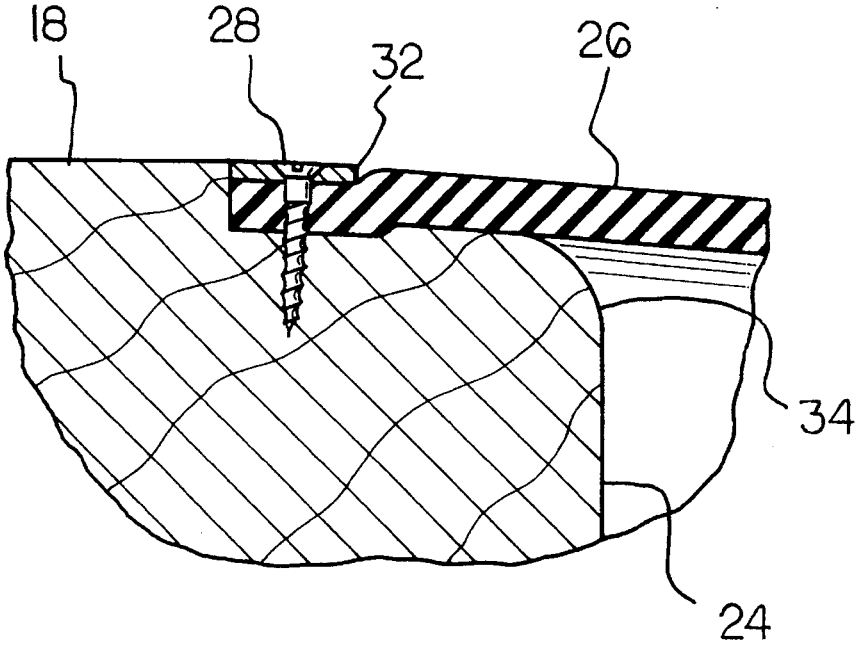
FIG. 3 is an enlarged cross sectional view of the area set forth in FIG. 2.
Figure 4:
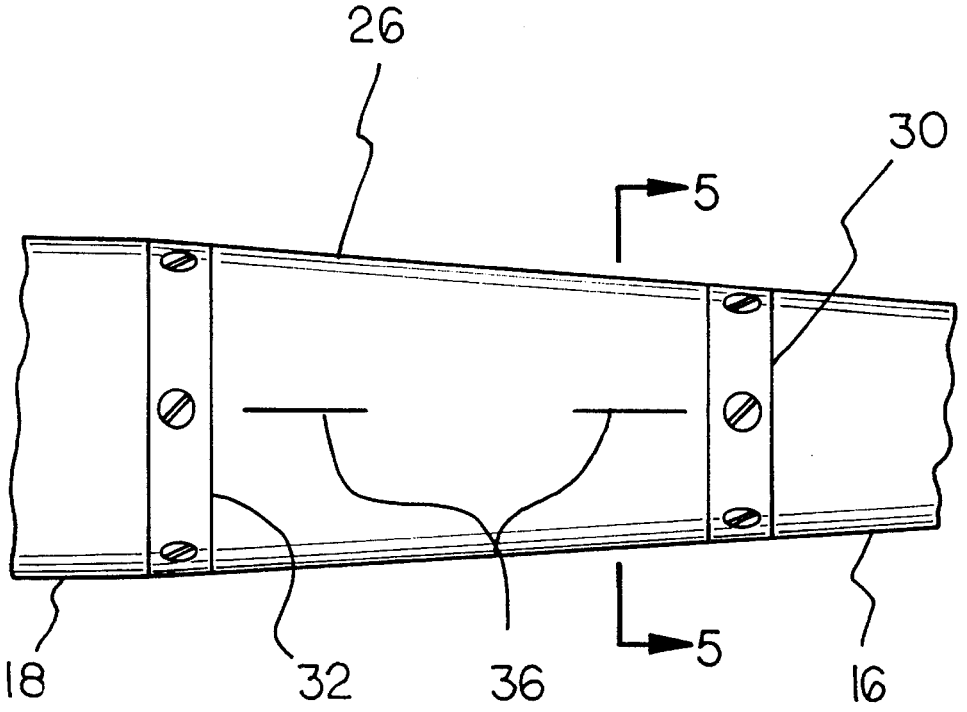
FIG. 4 is an enlarged elevation view of a coupling means of the present invention.
Figure 5:
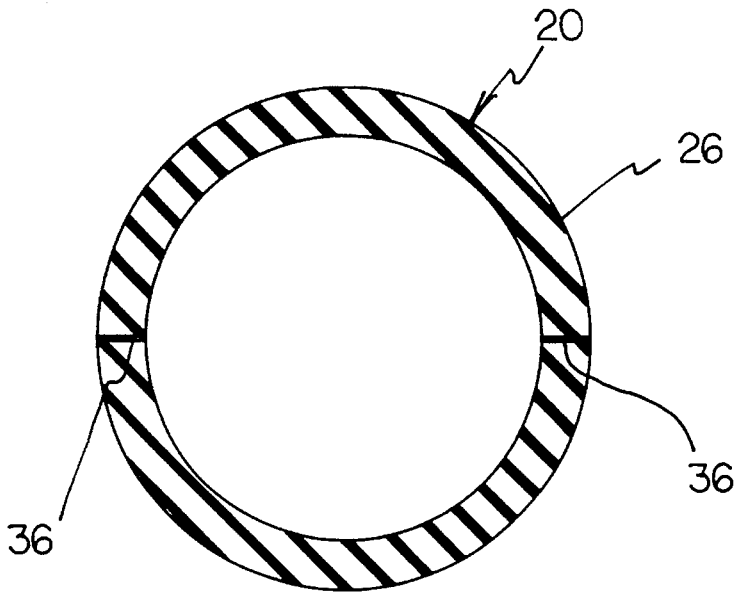
FIG. 5 is a cross sectional view taken along line 5—5 of FIG. 4.
Figure 6:
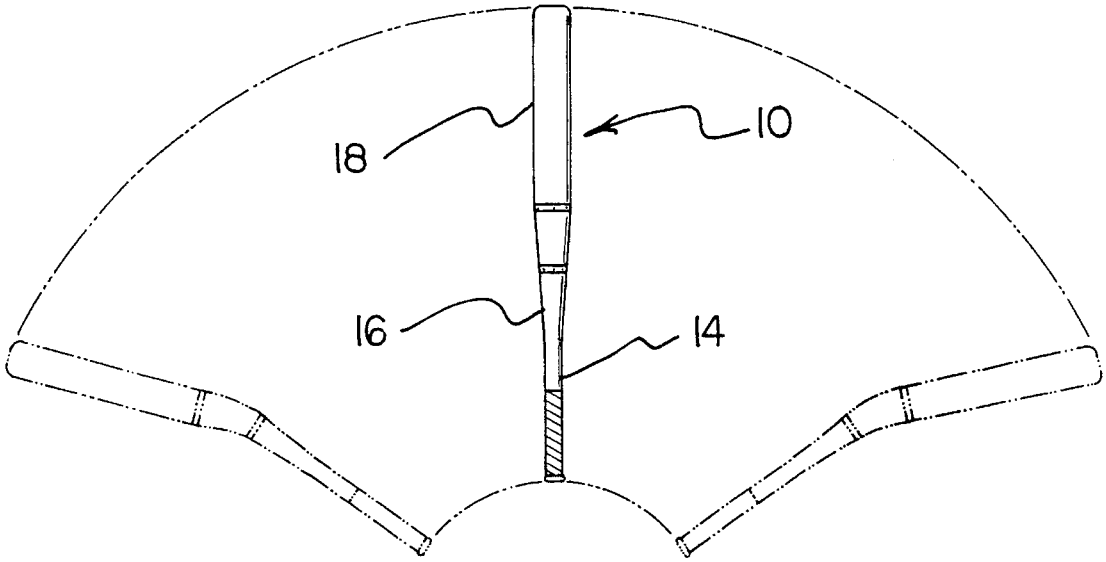
FIG. 6 is a plan view of the invention in use.

As best illustrated in FIGS. 2 through 5, it can be shown that the resilient coupling means 20 according to the present invention 10 preferably comprises a neck projection 22 extending from an outer free end of the tapered neck portion 16 of the baseball bat 12. The head portion 18 is shaped so as to define a head projection 24 extending therefrom into facing relationship relative to the neck projection 22 of the tapered neck portion 16. A resilient conical tube 26, as shown in FIGS. 3 and 4 of the drawings, is positioned over the neck projection 22 and the head projection 24 so as to support the projections in a substantially spaced and parallel orientation. The resilient conical tube 26 can be secured to the projections 22 and 24 by any conventionally known means, but is preferably secured thereto by a plurality of fasteners 28 directed through the resilient conical tube 26 and engaged to the respective projections 22 and 24. To preclude a tearing separation of the resilient conical tube 26 from the fasteners 28, it is desirable that the fasteners be directed through a neck portion securing ring 30 and into the neck projection 22, as well as head portion securing ring 32 and into the head projection 24. As shown in FIG. 3 for the head projection 24, the projections 22 and 24 are preferably each shaped so as to define an arcuate annular interior edge 34 positioned within the resilient conical tube 26 which reduces wear of the conical tube 26 against the respective projections 22 and 24. As shown in FIGS. 4 and 5, the resilient conical tube 26 can be shaped so as to define a plurality of relief slots 36 directed therethrough which permit breaking or bending of the resilient conical tube 26 within a desired plane. To this end, the relief slots 36, as shown in FIG. 5, are preferably directed through the resilient conical tube 26 and oriented such that all relief slots 36 reside within a common plane. The relief slots 36 further operate to permit pneumatic communication from an interior of the resilient coupling means 20 to exterior ambient air such that pneumatic pressure can be expelled from an interior of the resilient conical tube 26 during deformation thereof. By this structure, the resilient coupling means 20 permits the head portion 18 to resiliently articulate relative to the tapered neck portion 16 and the handle portion 14 during swinging of the baseball bat 12 as shown in FIG. 6 of the drawings. Such articulation of the head portion 18 relative to the handle portion 14 can be utilized to instruct or teach a person to swing the flexible section baseball bat 10 in a correct manner. Further, a "whip" effect can be obtained during swinging of the flexible section baseball bat 10 in as much as the head portion 18 continues beyond the handle portion during deceleration of the handle portion of the baseball bat 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A flexible section baseball bat comprising a handle portion for being grasped and manipulated by an individual, the handle portion is shaped so as to define a tapered neck portion of increasing cross sectional dimension;

a head portion for impacting a ball to accelerate the ball away from an individual;

a resilient coupling means interposed between the tapered neck portion and the head portion for permitting resilient articulation of the head portion relative to the handle portion during swinging of the bat, the resilient coupling means comprises a neck projection extending from an outer free end of the tapered neck portion, a head projection extending from the head portion and into a facing relationship relative to the neck projection of the tapered neck portion, and a resilient conical tube positioned over and secured to both the neck projection and the head projection so as to support the projections in a substantially spaced and parallel orientation;

the resilient coupling means further comprises a neck portion securing ring positioned about the neck projection and over the resilient conical tube, a head portion securing ring positioned about the head projection and over the resilient conical tube; and a plurality of fasteners directed through the rings and into the projections; and the resilient conical tube is shaped so as to define a plurality of relief slots directed therethrough, the relief slots are directed through the resilient conical tube and oriented such that all relief slots reside within a common plane.

* * * * *